United States Patent [19]

Keutgen et al.

[11] Patent Number: 5,054,539

[45] Date of Patent: Oct. 8, 1991

[54] PROCESS AND APPARATUS FOR THE MANUFACTURE OF AXIALLY SYMMETRICAL BODIES

[75] Inventors: Franz Keutgen, Lissendorf; Erich Willems, Oberstadtfeld; Siegbert Wagner, Dahlem, all of Fed. Rep. of Germany

[73] Assignee: Mannesmann AG, Düsseldorf, Fed. Rep. of Germany

[21] Appl. No.: 523,795

[22] Filed: May 15, 1990

[30] Foreign Application Priority Data

May 16, 1989 [DE] Fed. Rep. of Germany ..... 3916115

[51] Int. Cl.[5] ..... B22D 23/00

[52] U.S. Cl. ..... 164/457; 164/46; 164/155

[58] Field of Search ..... 164/46, 459, 155; 118/320, 321, 679, 686; 427/422, 425

[56] References Cited

U.S. PATENT DOCUMENTS 4,938,275 7/1990 Leatham et al. ..... 118/320

FOREIGN PATENT DOCUMENTS 0225732 6/1987 Fed. Rep. of Germany .
1599392 9/1981 United Kingdom .

*Primary Examiner*—Kuang Y. Lin
*Attorney, Agent, or Firm*—Nils H. Ljungman & Associates

[57] ABSTRACT

A process and apparatus for forming axially symmetrical bodies from molten metal droplets, where the droplets solidify to form the body on a rotating base, with the base moved in an extraction direction away from a spray plane of the metal droplets. The base is moved, the movement of the base and/or the quantitative flow of the metal droplets is controlled by a controller that communicates with a transmitter-receiver, preferably optical, that determines the position of the spray plane.

11 Claims, 1 Drawing Sheet

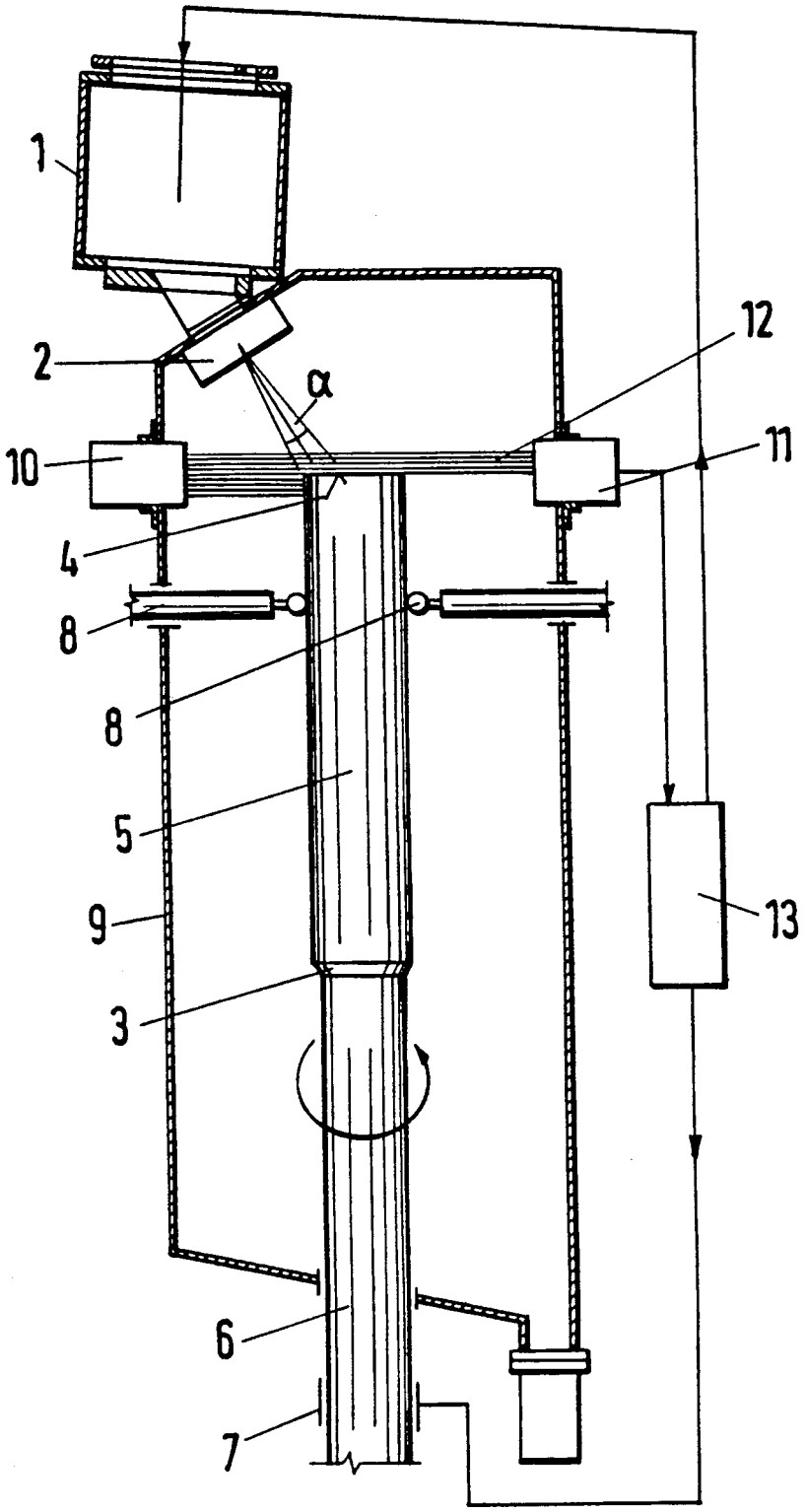
1
2
α
12
10
11
4
8
8
5
9
13
3
6
7

PROCESS AND APPARATUS FOR THE MANUFACTURE OF AXIALLY SYMMETRICAL BODIES

BACKGROUND OF THE INVENTION

1. Field of the Invention:

This invention relates to a process for the manufacture of axially symmetrical bodies by spraying a molten metal, e.g. molten steel and collecting the sprayed molten metal on a base.

2. Background of the Invention:

The manufacture of round products by spray forming is disclosed, for example, in EP-A1 0 225 732, EP-A1 0 188 994 or GB-PS 1,599,392, the contents of which are incorporated by reference herein. A common feature of all of these processes is that molten metal is atomized by means of a nozzle, and the metal droplets produced in this manner are collected on a rotating base, which base can be a plate having a vertical axis of rotation or a base having an inclined or horizontal axis of rotation.

The geometry and dimensions of the product are thereby a function of the quantity of molten metal flowing through the nozzle per unit of time, the angle of oscillation of the nozzle, the distance of the nozzle from the base and the speed at which the base is moved away from the nozzle or is transported past the nozzle. The objective is to achieve the specified dimension of a product by keeping the quantitative flow of the metal and a specified velocity of movement of the base constant. However, these objectives are not achieved in a satisfactory manner.

To produce round bars having a specified final length, a process is preferred in which the metal droplets are sprayed onto a horizontal plate which rotates around a vertical axis, while the plate is lowered vertically.

OBJECT OF THE INVENTION

The object of this invention is to significantly improve the processes of the prior art, so that the body produced has a diameter which is as constant as possible over its entire length.

SUMMARY OF THE INVENTION

The present invention is a process and apparatus for manufacturing a body having axial symmetry through the spraying of molten metal droplets on a base, where the droplets solidify to form a body, and vertically moving the base to increasingly build up the body.

According to the process, a rotating base is provided and molten metal droplets are sprayed onto and thereby collected on the rotating base in a spray plane. The base is, then, covered with metal droplets after one complete revolution of the base. The position of the base is continuously monitored during the spraying of metal droplets thereon. The base is moved away from the spray plane in a controlled manner, while rotating the same so that further metal droplets are collected on previously solidified droplets to form a body having axial symmetry. The speed of movement of the base away from the spray plane, or the quantitative flow of metal droplets, is regulated so as to maintain a desired position of the spray plane to which the metal droplets are directed.

Preferably, an optical transmitter-receiver is used to determine the position of the spray plane, which transmitter receiver communicates with a controller either to regulate the speed of movement of the base relative to the spray plane and/or to regulate the flow of metal droplets fed from a nozzle.

The apparatus includes a housing in which a rotating base and spray nozzle are provided. A reservoir feeds molten metal to the nozzle through which the molten metal is sprayed. The base is rotated and molten metal droplets are collected thereon while a transporter moves the base away from the spray plane to collect further metal droplets thereby forming an axially symmetrical body. Preferably, measurements from an optical transmitter-receiver at the spray plane are read by a controller that either controls the speed of the transport of the base relative to the spray plane and/or adjusts the flow of metal droplets from the spray nozzle.

One aspect of the invention resides broadly in a process for manufacturing axially symmetrical bodies from molten metal droplets comprising: providing a rotating base; spraying molten metal droplets and collecting the metal droplets on the rotating base in a spray plane, whereby the base is covered with the collected metal droplets after one complete revolution of the base; continuously measuring the position of the spray plane during the spraying of the metal droplets: and moving the base relative to the spray plane, while rotating the base, so as to form a body having axial symmetry on the base by further collection of metal droplets.

BRIEF DESCRIPTION OF THE DRAWING

The drawing is a schematic illustration of the present process and an apparatus of the present invention.

DESCRIPTION OF THE PREFERRED EMBODIMENTS

The present invention is based on a process for the manufacture of axially symmetrical bodies, such as cylindrical bodies, by spraying molten metal and collecting the produced metal droplets on a rotating base, in a spray plane, whereby the base is completely covered with metal droplets after one complete revolution, which metal droplets solidify to form a body. The process then includes the progressive movement of the base, while continuing the rotation, away from the collection position or spray plane. The position of the spray plane is measured continuously during the feed of the metal droplets, and the speed of movement of the base and/or the quantitative flow of the metal droplets from the nozzle is regulated so that a specified position of the spray plane is maintained.

In an additional embodiment of the invention, the position of the spray plane may be measured by an optically operating transmitter-receiver unit. Preferably, a light band is emitted by the transmitter that is parallel to a plane of the direction of extraction. The light band must preferably intersect the body outside a surface of the spray plane impacted by the metal droplets. The invention can be modified so that instead of the optical transmitter-receiver unit, which term is used to include systems using magnetic wave fronts for detection, a system may be used which can also be located in the space above the spray plane and operates on an acoustical basis. The apparatus for carrying out the process consists of a reservoir, a nozzle for atomization of the molten metal and a rotating base in spaced apart relation with the nozzle to collect the atomized molten metal. The base can be moved away from the nozzle by means of a transport device, with the nozzle and the base located in a housing. This apparatus can be refined according to the invention in that in the vicinity of the spray plane, alongside the base, there is an optical transmitter and a receiver. The base and/or the spray plane preferably lies in the optical path of the receiver, whereby the receiver is preferable connected to a controller which processes the measurement from the receiver. The controller is preferably connected to the transport apparatus and/or the apparatus for adjusting the amount of molten metal sprayed.

The invention is described in greater detail below, with reference to the accompanying drawing. As seen in the drawing, the melt or molten metal to be atomized is contained in a reservoir 1. The melt or molten metal flows from an opening in the bottom of the reservoir 1 and is atomized into fine droplets in the nozzle 2. The nozzle 2 is mounted so that it can oscillate. The oscillation range is indicated in the drawing by the pendulum angle (alpha). It is, therefore, possible to cover an adjustable range on a base 3. In the starting position the position of the spray plane is defined. The drawing shows the base 3 in the lowered position and the spray plane 4 being formed by the exposed end surface of the body 5 previously produced. The term "spray plane", as used herein, is used to define the desired plane of collection of a layer of the metal droplets during rotation of the base. Initially, "the spray plane" is the plane of the surface of the base 3. Subsequently, as the base is lowered, the term "spray plane" is defined as the plane of the end surface of the body being produced. The base 3 is held by a rod 6. Engaged with the rod 6 is a transport apparatus 7, which makes it possible to lower the rod 6 and, thus, the base 3. The body 5 produced is held in the desired position by a guide 8. The nozzle 2 and the base 3 are inside a housing 9 filled with inert gas.

According to the invention, fastened in or on the side walls inside the housing 9, at the level of the spray plane 4, there are means 10, 11 to measure the position of the spray plane 4, i.e., either at the start of the spraying process of the base 3 or during the spraying process of the exposed end surface of the body 5, located laterally alongside the body 5 to be produced. The means 10, 11 consist of a transmitter 10 and a receiver 11, both of which are known in the prior art. The transmitter 10 emits non-diffusing measurement beams in the form of a band 12, preferably in the form of laser beams. The band 12 lies in a plane parallel to the extraction or lowering direction of the base 3 in an area which intersects the body 5 outside a surface of the spray plane 4 impacted by the metal droplets. Opposite the transmitter 10 lies the receiver 11, with photosensitive cells corresponding to the beam band. The position of the base 3 or of the spray plane 4 can be determined directly from the optical "allocation" of the photosensitive cells. The measurements of the receiver 11 are conducted to a controller 13, which performs an evaluation of the measurements and compares them to a specified value for the desired position of the spray plane 4. Deviations from the specified value for the position of the spray plane 4 are corrected by a corresponding regulation of the transport apparatus 7, thereby causing a corresponding increase or decrease of the lowering speed of the rod 6. In this manner, movement of the base 5 is regulated to maintain a specified position of the spray plane. It is also possible to keep the spray plane 4 constant by having the controller 13 activate corresponding actuators to regulate the discharge of the melt from the reservoir 1. The actuators include the drive of a gate valve or a stopper rod of the reservoir, or, if the discharge opening of the reservoir 1 is constant and the flow quantity is determined by the level of molten metal in the reservoir, of a corresponding change in the amount of molten metal to be fed into the reservoir. In this manner, the quantitative flow of the metal droplets for a specified position of the spray plane is maintained.

The invention, therefore, keeps the spray plane from moving out of its specified position in the event of an irregular speed of descent or a change in the flow of the metal droplets, either of which can cause a reduction or even an enlargement of the specified diameter, or axial symmetry, of the body 5.

In summary, one feature of the invention resides broadly in a process for the manufacture of axially symmetrical bodies by spraying molten metal and capturing the metal droplets produced in this manner on a rotating base, whereby the base is completely covered with metal droplets after one complete revolution, and the continuous movement of the base, while still in rotation, out of the collecting position or spray plane. The position of the spray plane during the feed of the metal droplets is continuously measured and the velocity of movement of the base away from the spray plane and/or quantitative flow of metal droplets is regulated so that a specified position of the spray plane is maintained.

Another feature of the invention resides broadly in a process where the position of the spray plane is measured by a transmitter-receiver unit which operates optically.

Yet another feature of the invention resides broadly in a process where a light band emitted by a transmitter lies in the direction of propagation perpendicular to the extraction direction, or movement of the base away from the spray plane, and the width of the light band lies parallel to a plane of the extraction direction of the axially symmetrical body.

A further feature of the invention resides broadly in a process where the light band intersects the body outside a surface of the spray plane impacted by the metal droplets.

A yet further feature of the invention resides broadly in an apparatus for the performance of the process, comprising a reservoir and a nozzle for the molten metal to be atomized, a rotating base located at some distance from the nozzle and moved past the nozzle by transport means to collect the atomized melt, whereby the nozzle and the base are located in a housing, where in the vicinity or above a spray plane 4 there are a transmitter 10 and a receiver 11 located so that the base 3 and/or the spray plane 4 lie in the optical path of the transmitter 10, that the receiver 11 is connected to a controller 13 processing the measurement of the receiver 11, and the controller 13 is connected to the transport means 7 and/or an adjustment apparatus for the flow of the molten metal through the nozzle.

Yet another further feature of the invention resides broadly in an apparatus where the transmitter 10 and the receiver 11 are designed for the generation and/or processing of a light band, and are located opposite one another in the vicinity of the spray plane 4 alongside the base 3 or the spray plane.

An additional feature of the invention resides broadly in an apparatus where the spray plane 4 in the optical path of the transmitter 10 serves as a reflection surface of the beams.

In further summary, one feature of the invention resides broadly in a process for the manufacture of rotationally symmetrical bodies by spraying molten metal and capturing the metal droplets produced in this manner on a rotating base, whereby the base is completely covered with metal droplets after one complete revolution, and the continuous movement of the base, while still in rotation, out of the collecting position or spraying plane, characterized by the fact that the position of the spraying plane during the feed of the metal droplets is continuously measured and the velocity of movement of the base and/or the quantitative flow of the metal droplets is regulated so that a specified position of the spraying plane is maintained.

Another feature of the invention resides broadly in a process characterized by the fact that the position of the spraying plane is measured by a transmitter- receiver unit which operates optically.

Yet another feature of the invention resides broadly in a process characterized by the fact that a light band emitted by the transmitter lies in the direction of propagation perpendicular to the extraction direction, and the width of the light band lies parallel to a plane of the extraction direction of the rotationally symmetrical body.

A further feature of the invention resides broadly in a process characterized by the fact that the light band intersects the body outside a surface of the spraying plane impacted by the metal droplets.

A yet further feature of the invention resides broadly in an apparatus for the performance of the process consisting of a reservoir and a nozzle for the molten metal to be atomized, a rotating base located at some distance from the nozzle and moved past the nozzle by transport means to collect the atomized melt, whereby the nozzle and the base are located in a chamber, characterized by the fact that in the vicinity or above the spraying plane 4 there are a transmitter 10 and a receiver 11 located so that the base 3 and/or the spraying plane 4 lie in the optical path of the transmitter 10, that the receiver 11 is connected to a controller 13 processing the measurement of the receiver 11 and the controller 13 is connected to the transport means 7 and/or an adjustment apparatus for the flow of the molten metal through the nozzle.

Yet another further feature of the invention resides broadly in an apparatus characterized by the fact that the transmitter 10 and the receiver 11 are designed for the generation and/or processing of a light band, and are located opposite one another in the vicinity of the spraying plane 4 alongside the base 3 or the spraying plane.

An additional feature of the invention resides broadly in an apparatus characterized by the fact that the spraying plane 4 in the optical path of the transmitter 10 serves as a reflection surface of the beams.

All, or substantially all, of the components and methods of the various embodiments may be used with at least one embodiment or all of the embodiments, if any, described herein.

All of the patents, patent applications and publications recited herein are hereby incorporated by reference as if set forth in their entirety herein.

The details in the patents, patent applications and publications may be considered to be incorporable, at applicant's option, into the claims during prosecution as further limitations in the claims to patentably distinguish any amended claims for any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A process for manufacturing axially symmetrical bodies from molten metal droplets comprising:

rotating a base;

spraying molten metal droplets and collecting the metal droplets on the rotating base in a spray plane, whereby the base is covered with said collected metal droplets after one complete revolution of the base;

continuously measuring the position of the spray plane during the spraying of the metal droplets; and moving the base relative to the spray plane, while rotating the base, so as to form a body having axial symmetry on the base by further collection of metal droplets.

2. The process for manufacturing axially symmetrical bodies from molten metal droplets as defined in claim 1, including regulating the speed of movement of the base to maintain a specified position of the spray plane.

3. The process for manufacturing axially symmetrical bodies from molten metal droplets as defined in claim 1, including regulating the quantitative flow of the metal droplets to maintain a specified position of the spray plane.

4. The process for manufacturing axially symmetrical bodies from molten metal droplets as defined in claim 1, including measuring the position of the spray plane by an optical transmitterreceiver unit.

5. The process for manufacturing axially symmetrical bodies from molten metal droplets as defined in claim 4, including emitting a light band from the optical transmitter in a direction of propagation perpendicular to an extraction direction of the base, and the width of the light band lies parallel to said plane of extraction direction.

6. The process for manufacturing axially symmetrical bodies from molten metal droplets as defined in claim 5, intersecting the light band with the body outside the surface of the spray plane collecting metal droplets.

7. An apparatus for the manufacture of axially symmetrical bodies by spraying molten metal droplets and collecting the metal droplets on a rotating base comprising:

a housing;

a reservoir for molten metal;

a nozzle in the housing for discharging molten metal from the reservoir as molten metal droplets;

a base in the housing, said base spaced from the nozzle to receive and collect sprayed molten metal droplets in a spray plane, which collected molten metal droplets solidify to form a body;

means for rotating the base;

means for transporting the base for movement relative to the spray plane;

means for controlling the axial symmetry of a body formed on the base by collection of said molten metal droplets; and wherein the means for controlling the axial symmetry of said body comprises an optical transmitter-receiver unit located such that the spray plane lies in the optical path of the transmitter, and a controller communicating with the receiver to process measurements from the receiver.

8. The apparatus for manufacturing axially symmetrical bodies from molten metal droplets as defined in claim 7, wherein the controller is connected to the transport means to control the speed of transport of the base relative to the spray plane.

9. The apparatus for manufacturing axially symmetrical bodies from molten metal droplets as defined by claim 7, including means for adjusting the flow of molten metal through said nozzle, and the controller is connected to said means for adJusting said flow.

10. An apparatus for manufacturing axially symmetrical bodies from molten metal droplets as defined in claim 7, wherein the transmitter and receiver are located opposite one another adjacent said spray plane.

11. An apparatus for manufacturing axially symmetrical bodies for molten metal droplets as defined in claim 7, wherein the spray plane in the optical path of the transmitter serves as a reflection surface for the beams emitted by the transmitter.

* * * * *